US005485799A

United States Patent [19]

Julien

[11] Patent Number: 5,485,799

[45] Date of Patent: Jan. 23, 1996

[54] DEVICE WITH AT LEAST ONE VARIABLE-GEOMETRY AERODYNAMIC MEMBER INCLUDING A BOUNDARY LAYER CONTROL SYSTEM

[76] Inventor: Pierre Julien, 13 rue du Marèchal Joffre, 78110 Le Vesinet, France

[21] Appl. No.: 137,085

[22] PCT Filed: Apr. 14, 1992

[86] PCT No.: PCT/FR92/00330

§ 371 Date: Oct. 18, 1993

§ 102(e) Date: Oct. 18, 1993

[87] PCT Pub. No.: WO92/18381

PCT Pub. Date: Oct. 29, 1992

[30] Foreign Application Priority Data

| | | | |
|---|---|---|---|
| Apr. 17, 1991 | [FR] | France | 91 04719 |
| May 3, 1991 | [FR] | France | 91 05445 |
| Jul. 11, 1991 | [FR] | France | 91 08750 |
| Apr. 14, 1992 | [EP] | European Pat. Off. | 92401041 |

[51] Int. Cl.[6] ..... B63H 9/04

[52] U.S. Cl. ..... 114/103; 114/102

[58] Field of Search ..... 244/198, 204, 244/207, 208; 114/39.1, 39.2, 89, 97, 102, 103, 90

[56] References Cited

U.S. PATENT DOCUMENTS

| | | | |
|---|---|---|---|
| 1,567,531 | 12/1925 | Magni | 114/103 |
| 2,373,089 | 4/1945 | Allen et al. | 244/204 |
| 2,984,199 | 5/1961 | Giewald | 114/102 |
| 3,053,219 | 9/1962 | Coon | 114/103 |
| 3,598,075 | 8/1971 | Kenney | 114/102 |
| 4,006,701 | 2/1977 | Gorbellini | 114/102 |

FOREIGN PATENT DOCUMENTS

| | | | |
|---|---|---|---|
| 0389395 | 9/1990 | European Pat. Off. . | |
| 1531428 | 1/1970 | Germany . | |
| 0028790 | 2/1988 | Japan | 114/103 |
| 81/02144 | 8/1981 | WIPO . | |
| 86/00591 | 1/1986 | WIPO . | |

*Primary Examiner*—Edwin L. Swinehart
*Attorney, Agent, or Firm*—W. Thad Adams, III

[57] ABSTRACT

The member may for instance be a sail having at least one opening to create an air flow from the pressure face to the suction face, and guides to guide the air emerging from the opening on the suction face side and direct it tangentially in relation to the member. The opening and the guides are formed temporarily and adjusted by varying the position and/or geometry of at least one portion and/or region of the device. The device further includes devices for adjusting the member's geometry, including the shape and concavity of its camber.

8 Claims, 11 Drawing Sheets

DEVICE WITH AT LEAST ONE VARIABLE-GEOMETRY AERODYNAMIC MEMBER INCLUDING A BOUNDARY LAYER CONTROL SYSTEM

This application is a PCT application. This application claims the priority date of Apr. 17, 1991 for French Patent No. 91 04719.

The present invention relates to a device comprising at least one element of aerodynamic shape, at least one part or zone of which can be folded up, for propulsion and/or lift using the effect of the relative wind.

More precisely, the invention relates to a device of the aforementioned type with great adjustable lift, which is intended for any craft which can be set in motion in the air, on water or on land, such as a boat, sailboard, aircraft, flying wing, kite, land yacht, etc. The invention is also applicable to the production of models of these locomotion or sport crafts.

Before going any further, for clear understanding of the prior art and of the invention, the meaning of expressions used in the present description and in the claims will be defined:

- pressure face: (I—FIG. 1*b*) face of the element of aerodynamic shape which is at an increased pressure (in other words, face of the element which receives the wind);
- suction face: (E—FIG. 1*b*) face of the element of aerodynamic shape at a reduced pressure;
- leading edge: (BA—FIG. 1*b*) point, line, region furthest upstream of the element of aerodynamic shape, or of one of its parts or zones, viewed in the direction of the relative displacement of the air with respect to the said elements;
- trailing edge: (BF—FIG. 1*b*) point, line, region furthest downstream of the element of aerodynamic shape, or of one of its parts or zones, viewed in the direction of the relative displacement of the air with respect to the said element;
- profile: shape of a cross-section of the element of aerodynamic shape taken in the direction of flow of the air;
- skeleton of a profile: line connecting the leading edge to the trailing edge and passing between the pressure face and the suction face and at an equal distance from the latter:
- chord of a profile: (CP—FIG. 1*b*) straight line connecting the leading edge to the trailing edge;
- hollow of a profile: (C—FIG. 1*b*) maximum distance between the chord and the skeleton of a profile.
- hauling point: linking point which can act as a moving control or fixing point.

There are known, for example from DE-1,531,328 LEMOIGNE, devices of the aforementioned type in which the said element has two faces designed to be located respectively on the pressure face side and the suction face side, at least one opening being provided to establish a passage of air from the pressure face side to the suction face side, and guide means being provided to direct the air emerging from the said opening on the suction face side, and give it a direction which is tangential to the said element.

The problem which is it sought to resolve by providing openings for the passage of air in such elements of aerodynamic shape is to prevent the boundary layer of the flow of air, on the suction face side, from "detaching" from the element in the region of the line of greatest hollow, which it tends to do when the element is curved. This detachment of the flow limits, and even decreases the aerodynamic performance. By allowing a passage of air from the pressure face to the suction face air is reinjected at a greater speed compared to that of the boundary layer which, thus reactivated, follows the aerodynamic shape of the element.

In doing so, however, it is necessary to avoid creating, especially on the suction face side, variations in shape which affect the aerodynamics of the element. Indeed, any alteration to this shape, however minimal this might be, generates disturbances in the flow of the boundary layer of air and promotes its detachment.

To improve the flow of the air, when the element of aerodynamic shape is a thick sail structure, LEMOIGNE proposes equipping such sail structures with traversing channels which are permanent means for guiding the air, which are materially defined by channel walls and whose cross-section decreases in the direction of the stream, the objective being thus to create a venturi tube. To the same end, where thin sails are concerned, LEMOIGNE proposes to equip them with nozzles which project greatly on the suction face side, hampering the profile of the sail structure in terms of aerodynamics.

The object of the present invention is to propose means which improve the flow of the air from the pressure face to the suction face, so that the air emerges on the suction face as a stream with the same direction and same sense as those of the overall flow on the suction face at the point of junction of the said stream and of the said overall flow, and this being:

- whilst allowing the element to retain its aerodynamic shape (that is to say without discontinuity, without a hollow or any obstacle which, inter alia, forms a deflector), even when the passage of air is not taking place, when the aerodynamic element is only slightly curved for example,
- and by applying a principle which is suitable for any element of aerodynamic shape, particularly both for thin sail structures and for thick sail structures.

This object is achieved in this sense that in the device according to the invention, the said opening and the said guide means of the said air passage are created temporarily and set by modifying the position and/or the geometry of at least one part and/or zone of the said device and the said device further comprises means designed to set the geometry of the said element, namely at least the curvature in terms of shape and in terms of hollow.

The air passage opening may equally well be continuous or discontinuous (it is clearly understood that this is a continuity or discontinuity in space, not in time).

Preferably, the inlet or outlet cross-section of the air passage, located at the end of a leading edge and/or of a trailing edge of a part or zone of the element is substantially perpendicular (1) to the streamlines of the flow of air going from the pressure face to the suction face and (2) to the pressure face or the suction face at the point of the inlet or outlet cross-sections.

The position and the geometry of the opening may be adjustable and this position may be independent of the side of the concavity resulting from the curvature. One of the possible settings is obtained by displacing parts or zones of the element of aerodynamic shape with respect to one another in longitudinal or transverse directions or in rotation, in a plane perpendicular to the element and/or to its parts or zones, by pulling a leading edge and/or a trailing edge of the said element, part or zone and/or the respective region of these edges.

The setting of the geometry of the slits may be carried out without changing the positioning of the trailing edge formed by the means for guiding the stream of air which passes through the said opening.

SUMMARY OF THE INVENTION

The invention therefore relates to a device which comprises the element of aerodynamic shape and the means which give it its geometry, to vary its lift and its drag and, in some cases, its orientation with respect to the craft which the device equips. To this end, these means may act on the shape and/or the extent of its curvature, its twist, its span, its surface area etc. The element of aerodynamic shape may thus be hauled down partially and/or totally.

The thickness may be fixed by construction and/or be given by a setting by virtue of the positioning means.

As regards the skeleton of the profile of the element of aerodynamic shape, it can form a line with variable curvature and this curvature may never be zero. The skeleton may have a curvature exhibiting just one concavity. It is not necessary to vary the length of the skeleton to change its side concavity.

Without a suitable system, the creation and/or setting of the air passage opening or openings and of the means for guiding the stream of air are independent of the overall geometry of the element of aerodynamic shape, particularly of the length of the skeleton, of its profile.

The element of aerodynamic shape may be made in one or more parts and/or zones secured together or detached, capable and/or incapable of moving with respect to one another. It may include at least one extensible zone. The position of the element of aerodynamic shape and/or of its various parts and/or zones may be set with respect to the craft which the device to which the element belongs equips.

The element of aerodynamic shape and/or its various parts and/or zones may have reversible concavity.

It should be noted that, in the majority of known elements of aerodynamic shape, the curvature is defined, more or less, by construction, so that a given element is suitable only for a restricted condition of use and so that, if this is a sail of a boat for example, a whole set of sails must be available. However, the invention tends to propose an element of aerodynamic shape for universal use, which can be adapted in situ to all conditions and speeds likely to be encountered, because the shape of the skeleton of the profiles of the said shape is a setting choice. The deformations of the shape are possible without necessarily giving rise to a break in a curve other than that created by the open air passages, the external surface of the element retaining, depending on the setting, continuous curved lines promoting the flow of the air.

Without a suitable automatic control system, the geometry of the aerodynamic shape of the element is independent of its orientation with respect to the craft which it equips. In a preferred embodiment, however, the said means for setting the curvature belong to positioning means which are further designed to set the orientation of the said element with respect to the said craft.

The positioning means act by positioning, adjustably, with respect to each other and/or with respect to the craft, certain points and linking zones between the element of aerodynamic shape and the positioning means. These means may be chosen, for example, from among the following elements, which are fixed or movable with respect to one another and whose geometry may be variable: girder, frame, truss girder, mast, pivoting mast-wing, bipod mast, tripod mast or L-shaped mast, hoop, pylon, wishbone, boom, bracket boom, articulated arm, sprit, strut, batten, rail, carriage, tackle, jack, and all the upper-works, part of the rigging, and mechanical, pneumatic, electromechanical and hydraulic control means known in the fields in question.

Boom in the shape of a bracket is understood to be a boom having a first and a second branch substantially at right angles, the first branch acting as an actual boom and the second branch, mounted so that it can pivot on the craft which the device equips, acting as support for the first branch.

The positioning means may be located on the outside, partially on the inside, or entirely on the inside of the element of aerodynamic shape, or may be built into it.

These positioning means may act on the orientation of the element of aerodynamic shape by causing it to pivot about an axis, for example about a mast.

To sum up, the positioning means may comprise a structure including one or more elements likenable to a conventional boom or boom in the shape of a bracket, to a sprit or to a wishbone, the said element or elements itself or themselves comprising at least one part with variable geometry.

Part with variable geometry is understood to be one which is articulated and/or sliding and/or flexible and/or extensible.

The element of aerodynamic shape may include hauling points formed in its edges, other than the conventional hauling points and, amongst these specific hauling points, one is preferably located substantially in the alignment of the said air passage opening or openings.

The hauling points are connected to a spar (boom, girder, etc.), or to a moving structure, itself connected to the craft which the device according to the invention equips and/or itself held by the operator. As a variant, the hauling points may be connected directly to the said craft. The links allow settings by fixing the lengths between the hauling points and the anchoring points, which themselves may be on the craft, on the spar, on an intermediate structure with adjustable position.

The device is designed to fit, inter alia, onto existing sailing craft, modifying them to a minimum extent. Thus, if the device includes stays, rigging, sheets, downhauls or other elements of the positioning means and the rigging which transmit loads, then at least some of them, and preferably the stays and the rigging, will be connected directly to the craft equipped with the present device.

When the said element has a leading edge and a trailing edge, and in some configurations, the said leading edge may be positioned outside of the longitudinal axis and axis of displacement of the craft which the device according to the invention equips.

Advantageously, at least one hauling point is provided between the two ends of the said leading edge, and a variable-geometry stiffening element which is continuous or discontinuous may preferably equip the said leading edge over all or part of its length, which makes it possible to give the leading edge its own mobility.

The stiffening element may, for example, be flexible, articulated, etc.

Such own mobility has the benefit of giving an optimum angle of incidence to the leading edge of the element at its various levels. Angle of incidence is understood to be the angle formed by the direction of the relative stream of air and the chord of the aerodynamic element, or of one of its parts or zones. The stiffening element may have a shape with variable geometry and which is adjustable. This may, for example, be a stay or a winder. By virtue of such means, it is possible to obtain a variation by bending and/or mobility of the parts of the said variable-geometry stiffening element, with respect to one another, it being possible for the stiffening element to have a curved and/or broken line in its longitudinal direction.

At least one link is provided between the hauling point or points formed on the leading edge and/or on the stiffening element and another point of the device to which the element of aerodynamic shape and/or the element of the craft which it equips belongs. The tension in each carefully orientated link makes the leading edge assume the desired shape.

Each leading edge of the various parts and/or zones may benefit from the same means as the other leading edges giving them their own mobility.

In a first possible embodiment of the invention, designed for propelling a sailing boat, but which can also serve in lift, the element of aerodynamic shape is a sail structure made as a single part divided into at least two sub-parts along a dividing line and designed to form between them a slit affecting all or part of the said line, the said sail structure sub-parts overall forming a sail structure plane over all of which positioning means are designed to act.

A device of this type is known from U.S. Pat No. 3,053,219 COON. This patent shows a sail divided into several parts, but these parts are connected to one another by legs 40, so that it is impossible to control the parts of the sail individually, for example to act on their individual curvature and on their relative position, and therefore on the shape of the overall curvature of the sail structure and on the geometry of its slits.

In contrast, according to the invention, these positioning means affect both the sail structure plane as a whole, and each sub-part of the sail structure, taken in isolation, so that it is possible, in particular, to curve them individually. In some cases, the said positioning means further make it possible to reduce the surface area or to haul down each sail structure sub-part.

In a particular case of the first embodiment, two consecutive sail structure sub-parts have an overlap zone, the said slit being defined by the spacing between the said sail structure sub-parts, in the overlap zone.

Such an overlap may also take place in the case where the slit is discontinuous.

In a manner known per se, to avoid the sail structure sub-parts becoming stuck to one another in the overlap zone at an instant where it is desired for the slit to be open, the spacing is maintained by at least one spacer. As opposed to the prior art, as represented by COON for example, where the spacer which each leg 40 constitutes is fixed to the two facing parts of the sail, according to the invention, at least one of the two sail structure sub-parts having an overlap zone is not fixed to the spacer. The spacer, which may roughly be in the shape of a wedge becoming thinner in the upstream direction, may be fixed to the other sail structure sub-part or, when the said sail structure is held at one end by a support which is integral with it, such as a mast or a girder, the spacer may be fixed to this support and/or to an aerodynamic fairing of this support.

This support, preferably exhibiting an aerodynamic shape, such as a mast-wing, may, for example, occupy the position of one of the sail structure sub-parts.

Preferably, the spacer has a modifiable configuration and/or position capable of participating in setting the spacing and/or the geometry of the slit.

In a second embodiment of the invention, designed to propel a sailing boat or to serve as a lift plane for an aircraft, the two faces of the element of aerodynamic shape belong to separate skin parts which define between them a hollow aerodynamic volume; the opening and the guide means of the air passage are created by a pair of flaps formed respectively in one and the other face and which are subjected to control means acting on their closing/opening, on their orientation and on their geometry, the opening of the flap on the suction face side taking place by displacing the upstream free edge of the flap towards the inside of the cavity of the aerodynamic volume, so that the face of the skin on the suction face side retains its aerodynamic profile despite the opening of the flap.

On the pressure face side, the opening of the flap may take place equally well by displacing the downstream free edge of the flap towards the inside of the cavity of the aerodynamic volume or by displacing the upstream free edge of the flap towards the outside of the said cavity of the volume. In both cases, the face of the skin on the pressure face side offers an aerodynamic profile to the passage of air through the opening and to its flow over the pressure face.

The flaps may be flexible.

The means for controlling the flaps depend on a variable-geometry structure housed in the cavity of the hollow aerodynamic volume.

This structure is subjected to setting means and it gives the cross-section or various cross-sections forming the profile or profiles of the aerodynamic shape. More precisely, the said setting means act, in magnitude and/or shape, on one or more of the characteristics of the geometry of the said structure chosen between the curvature, the thickness, the amount of twist, the span and the surface area, and the said structure is connected to the skin so that by setting the geometry of the said structure, that of the aerodynamic volume is controlled.

In a practical embodiment of the invention, the variable-geometry structure includes:

a system for spacing the ends of the skin giving it its span;

at least one variable-geometry frame consisting of at least one plate including at least one pair of moving parts for joining the said plate to a pair of deformable shaping battens, in one or more parts, arranged respectively on either side of the said plate, from the leading edge to the trailing edge of the said element, the said battens being connected, or at the very least in contact, with the face of the skin which adjoins them.

A frame may consist of several plates arranged end to end, and possibly articulated together.

The shaping battens define the external contour of the aerodynamic volume and define a profile of the aerodynamic shape. The curvature and the shape of each frame may both be obtained by the difference in length of the two shaping battens of the said frame, which are kept suitably spaced apart by the plates and/or struts which may themselves be of adjustable length.

The spacer system may itself be adjustable. It may consist of a traversing guide support, such as a mast or a girder, on which the said frame or frames slides or slide. To this end, the guide support passes through an opening provided in the said frame or frames, the or at least one of the said openings preferably being of adjustable cross-section.

When the structure includes several frames, means are provided for limiting the spacing between them.

In any case, the frame or frames are blocked against any rotation about the guide support.

The skin may include extensible zones and/or be made in at least two parts, these parts exhibiting overlap zones.

A third embodiment, suitable for the propulsion of a sailing boat or for the lift of an aircraft, proceeds both from the first embodiment in the sense that it applies to a thin sail structure, and from the second embodiment in the sense that it uses flaps.

More precisely, according to this third embodiment, the element of aerodynamic shape is a sail structure and a flap creates the said opening and the said guide means of the said air passage, which flap is defined by a slit termed "supple" substantially perpendicular to the direction of flow of the air in the normal position of use and by two slits termed "stiffened" substantially parallel to the said direction, so that the flap has roughly the shape of a C, the said stiffened slits being so owing to the presence, in the sail structure, of stiffening battens running alongside the said slits and extending beyond those of their ends which are opposite the said supple slit.

Substantially perpendicular is understood to be a direction lying between exactly perpendicular and slightly oblique.

The flap may be subjected to control means comprising at least one batten termed "control batten" built into the said sail structure in a direction substantially parallel to the stiffened slits, the said control batten preferably having at least one zone of weakened stiffness designed to promote the bending of the said batten at the level of this zone.

Preferably, the said control batten also sets the shape of the curvature and/or of the amount of twist of the said element.

Each flap may be subjected to two control battens located on either side of the said flap.

Preferably, the said or one of the said control battens is substantially coextensive with the lower edge of the sail structure.

At least one stiffening batten and at least one control batten may be contiguous.

In a particular variant of the third embodiment, the sail structure includes at least two flaps the supple slits of which are aligned and in another variant it includes at least two flaps, the supple slits of which are not aligned.

One and the same sail structure may simultaneously correspond to these two variants by having at least two parallel rows of several flaps each.

It may be advantageous for one or more flaps to be further provided with manoeuvring means acting directly on its or their position.

The sail structure may include extensible zones for absorbing the deformations and/or acting as a return means. The flaps may be connected to the sail structure by supple links to limit their outward travel and/or extensible links to damp out their movement.

In the case where the sail structure of the first or third embodiment is held at one end by a support, such as a mast or a girder, the said support may be located beside the sail structure plane or be integrated into part of the sail structure plane. Still in this same case, the support may, in a manner known per se, have an aerodynamic profile, and according to the invention, this aerodynamic profile may be obtained by surrounding the said support, over all or part of its length, with a fairing made from at least one part, which fairing is mounted so that it can rotate about the support.

The trailing edge of the aerodynamic support may be connected to the sail structure or to one of its parts.

If the support is rigged and equipped with at least one crossbar it is preferable, according to the invention, for this crossbar to have a curved shape offering a cutaway in the vicinity of its junction with the support.

With the device according to the invention, when changing the concavity of the sail structure and depending on the setting, a leading edge or a trailing edge formed by an open slit is on the side of the concavity.

To permutate the position of a leading edge and of a trailing edge it is not strictly necessary to change the position of all of the hauling points of the parts or zones of the element of aerodynamic shape in question.

BRIEF DESCRIPTION OF THE DRAWINGS

The invention is described in detail hereafter by reference to the appended drawings in which.

DESCRIPTION OF THE PREFERRED EMBODIMENT AND BEST MODE

Figure 1B:
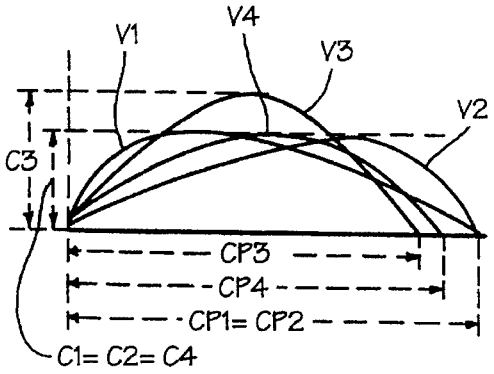
FIG. 1*b* is a diagram illustrating the notions of shape and of hollow of a curvature and that of profile.

FIG. 1*b* will be described first of all, where four sail structures V1, V2, V3, V4 of the same skeleton length can be seen. The sail structures V1 and V2 have the same hollow C1, C2 and one and the same chord CP1, CP2. The sail structures V2 and V3 have a different chord CP2, CP3, and a different hollow C2, C3. The sail structures V1 and V4 have the same hollow C1, C4 and a different chord CP1, CP4. It follows that the sail structures V1, V2, V3 and V4 all have a curvature of a different shape.

Figure 1:
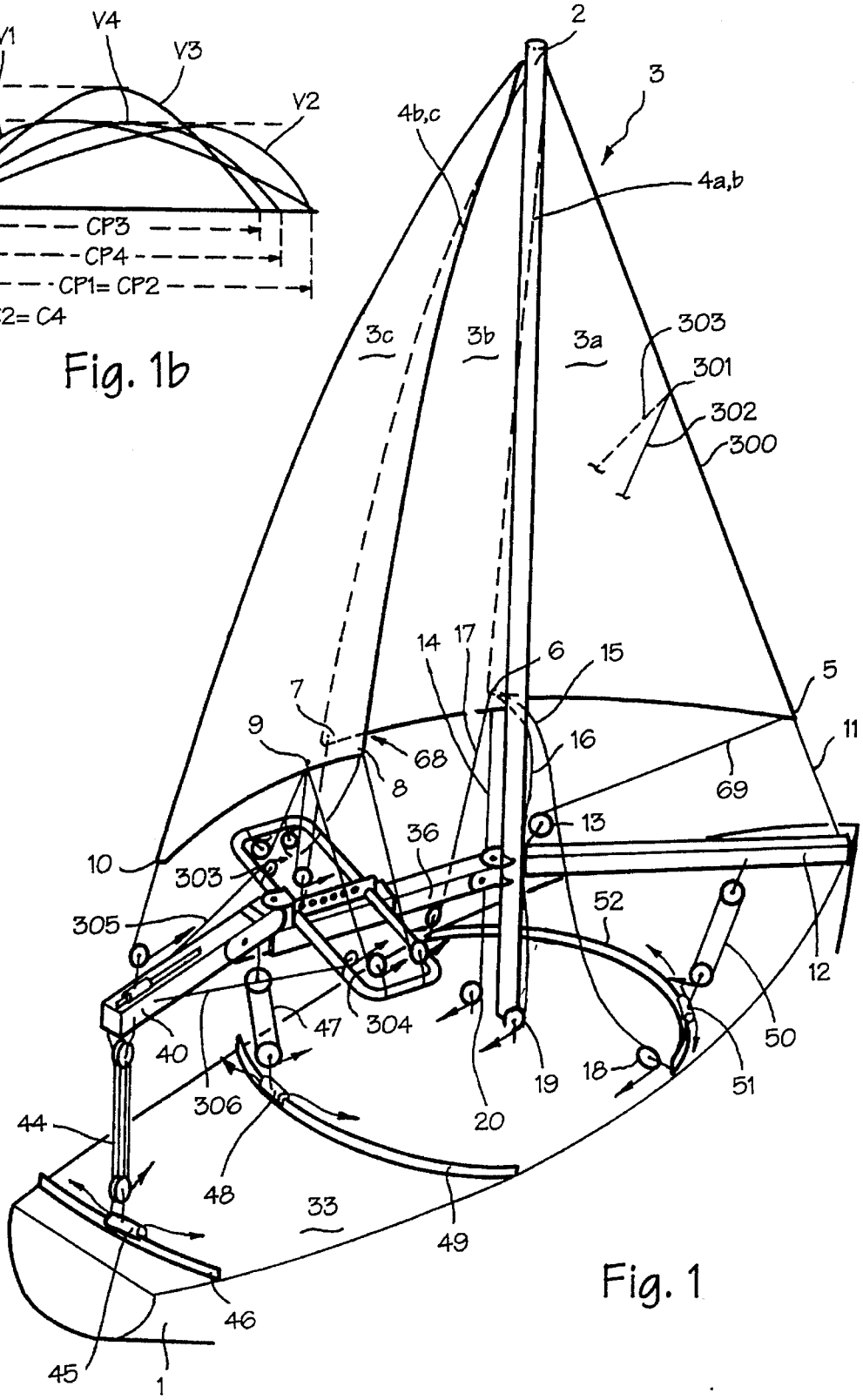
FIG. 1 is an overall view, in isometric projection, of a sailing craft provided with a device according to the invention, in its first embodiment.
Figure 1A:
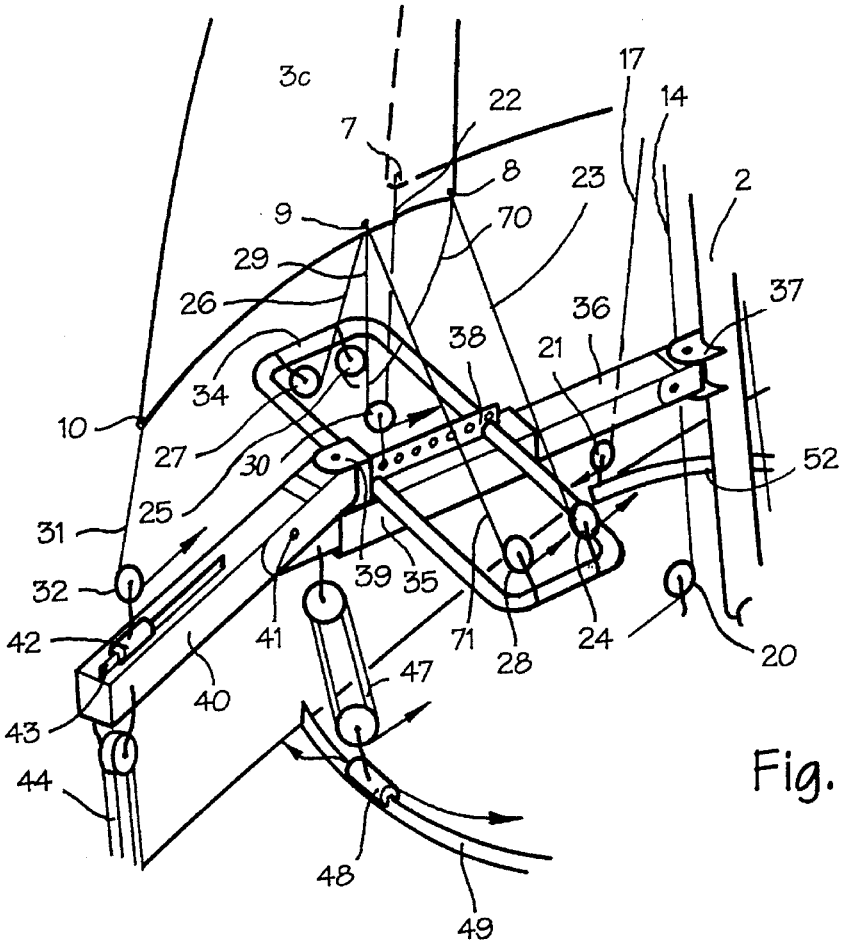
FIG. 1*a* is a zone on a larger scale of FIG. 1.

If reference is made to FIG. 1 and to its enlarged detail of FIG. 1*a*, a single-hulled sailing craft 1 can be seen, equipped with a mast 2 which supports a thin sail structure denoted overall by 3, made in a single part, which is divided into three sub-parts 3*a*, 3*b*, 3*c* having overlap zones 4*ab*, 4*bc* between them. These overlap zones define between them slits 68 (FIG. 6) with adjustable geometry and which can be opened, or closed, to a greater or lesser extent. The sail structure sub-parts exhibit hauling points, particularly 5–10 on their lower edge by means of which the various settings and manoeuvres of the sail structure sub-parts are made.

Thus, the hauling point 5 acts as a fixed link for two hauling ends 11 and 69 one of which is connected to the end of a boom 12 articulated on the mast 2, whereas the other passes around a return pulley 13 which is fixed to the mast 2.

The hauling point 6 acts as a fixed link for one of the hauling ends 14–17 the other end of which passes around return pulleys 18–21.

The hauling point 7 acts as a fixing for hauling end 22 the other end of which is fixed to a crossmember 38 described later.

The hauling point 8 acts as a fixed link for two hauling ends 23 and 70 passing respectively around return pulleys 24 and 25. Likewise the hauling point 9 acts as a fixed link for three hauling ends 26, 29 and 71 passing respectively around return pulleys 27, 30 and 28.

Finally, the hauling point 10 serves as a fixing for a hauling end 31 passing around a return pulley 32.

The return pulley 13 depends on the mast 2.

The return pulleys 18 and 21 are connected to the deck 33 of the sailing craft.

The return pulleys 19 and 20 are fixed to the deck 33 of the sailing craft downstream of the foot of the mast 2.

The return pulleys 24, 25, 27, 28 are fixed to a framework 34 mounted on a carriage 35 sliding over part of the boom 36 which, itself, is mounted so that it can pivot at 37 on the mast 2 without being capable of rotating about its own longitudinal axis. The framework 34 supports an extensible crossmember 38 exhibiting a series of holes offering a choice of positions for fixing the return pulley 30 and the hauling end 22. The framework 34 further supports two pulleys 303, 304 around which there pass two hauling ends 305, 306 which control the position of the boom part 40. These elements have not been transferred onto FIG. 1*a* so as not to clutter it.

It is thus understood that the framework 34 which to a great extent overhangs the longitudinal axis of the variable-geometry boom 12, 36, 40 makes it possible to fix the control members, such as pulleys, serving to position the sail structure and the various parts of the boom.

To the carriage 35 is fixed a stirrup 39 in which one end of a boom part 40 is mounted so that it can pivot. At a point relatively close to this end, this same boom part 40 is mounted so that it can pivot at 41. As a variant, instead of being mounted so that it can pivot at 41, the boom part 40 could be flexible.

The return pulley 32 is connected to a carriage 42 capable of being displaced along a rectilinear rail 43.

The end of the boom part 40, opposite the stirrup 39, is connected by a tackle 44 to a similar carriage 45 capable of being displaced along a slightly arched rail 46.

Likewise, the end of the boom part 36, opposite the mast 2, is connected by a tackle 47 to a similar carriage 48 capable of being displaced along an arched rail 49, and the boom part 12 is equipped with a similar arrangement of tackle 50, carriage 51 and arched rail 52. As can be seen, the concavity of the rail 49 and that of the rail 52 point towards one another, and towards the mast.

There is further provided, on the leading edge 300 of the sail structure sub-part 3*a*, a hauling point 301 to which are fixed two hauling ends 302, 303 connected to the craft.

It is understood, from the means which have just been described in detail, that the sail structure sub-parts 3*a*, 3*b*, 3*c* may be controlled individually, especially as regards their curvature, their twist, their reduction in surface area, or their hauling down.

In the embodiment of FIG. 1, the sail structure plane P passes through the mast which is integrated into the sail structure sub-part 3*b*. This situation is represented diagrammatically in FIG. 2*c*.

Figure 2A:
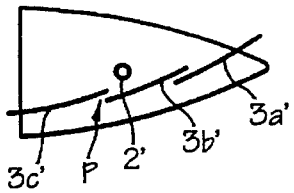
FIGS. 2*a*, 2*b* and 2*c* are diagrammatic representations of three possible positions of the mast with respect to the sail structure sub-parts.

As a variant, as shown in FIG. 2*a*, the mast 2' could pass beside the sail structure plane P.

Figure 2B:
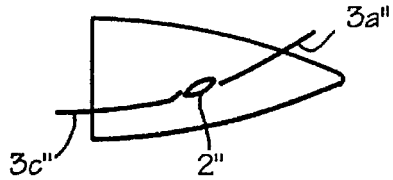

Again as a variant, one of the sail structure sub-parts could be replaced by the mast as is seen in FIG. 2*b*. In this case, the mast 2" would be suitably profiled to be integrated into the aerodynamic shape of the rest of the sail structure 3*a*", 3*c*".

Figure 3:
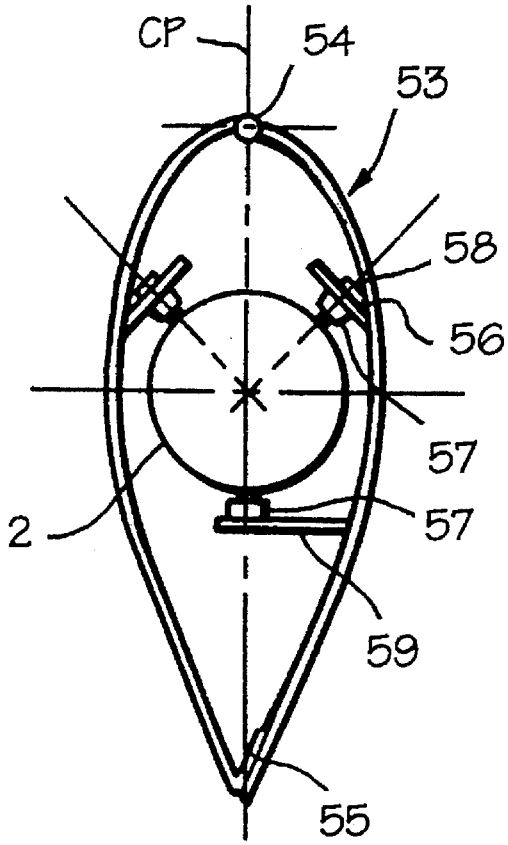
FIG. 3 shows, in transverse section, one possible embodiment of the faired mast.

In a manner known per se, the mast 2 advantageously has an aerodynamic shape to generate less drag. According to the invention, this shape may be given to it by a fairing as is seen in FIG. 3. More precisely, a fairing 53 is mounted so that it can rotate on the mast 2, which fairing is made of two parts articulated about hinges 54 on the leading edge side, and joined together on the trailing edge side by screwing at 55. The internal faces of the fairing are equipped with flexible supports 56 provided with retractable thrust ball-bearings 57, which supports are symmetrical with respect to the chord CP of the profile of the fairing. The supports 56 further make it possible to fix balancing masses 58 so that the centre of wind thrust is downstream of the centre of gravity of the fairing which, preferably, is coincident with the axis of rotation of the fairing. Another flexible support 59 supports a thrust ballbearing 57 along the axis of the said chord. It is understood that the fairing 53 can orientate itself into the wind, like a vane, and that the flexible supports 56 and 59 allow the fairing to rotate even about a mast whose cross-section is only approximately circular.

Figure 2C:
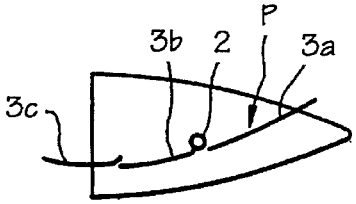
Figure 4:
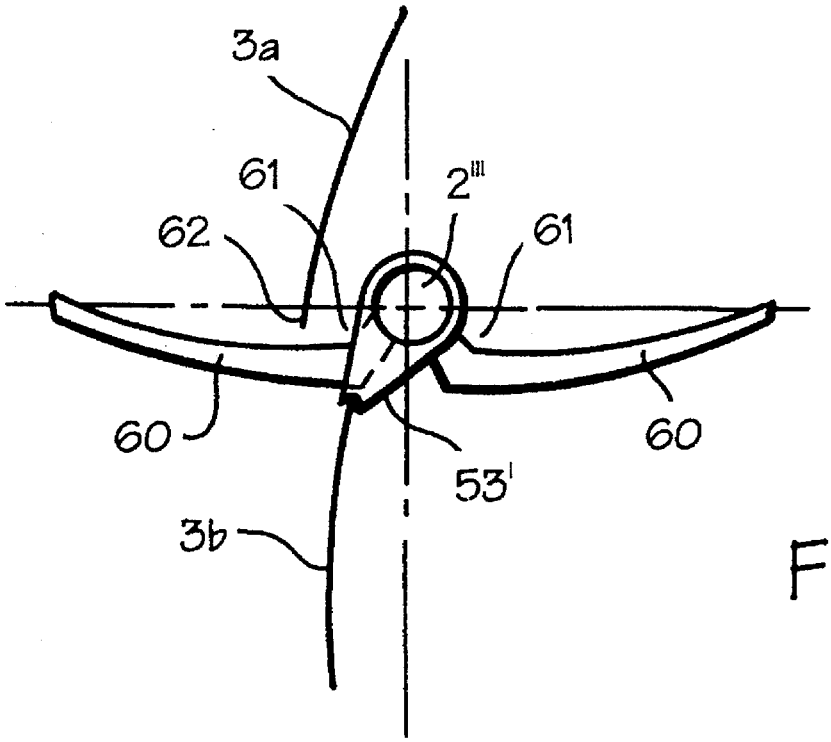
FIG. 4 shows, also in transverse section, a mast equipped with crossbars.

FIG. 4 shows an integral mast 2''', such as that of FIG. 2*c*, provided with crossbars 60, and to the fairing 53' of which is connected the sail structure sub-part 3*b*. As can be seen, these crossbars have a curved shape offering a cutaway 61 level with their junction with the mast 2''', by virtue of which cutaway the crossbars 60 do not hinder the positioning of the trailing edge 62 of the sail structure sub-part 3*a*.

It is known that when two parts of sail have an overlap zone, such as 4*a*, *b* and 4*b*, *c* (FIG. 1) and when the distance between the said parts in the said zone is relatively small, these may become stuck to one another. To avoid such an untimely closure of the slit which it is desired to form between two sail structure sub-parts, it is known to place one or more spacers.

Figure 5:
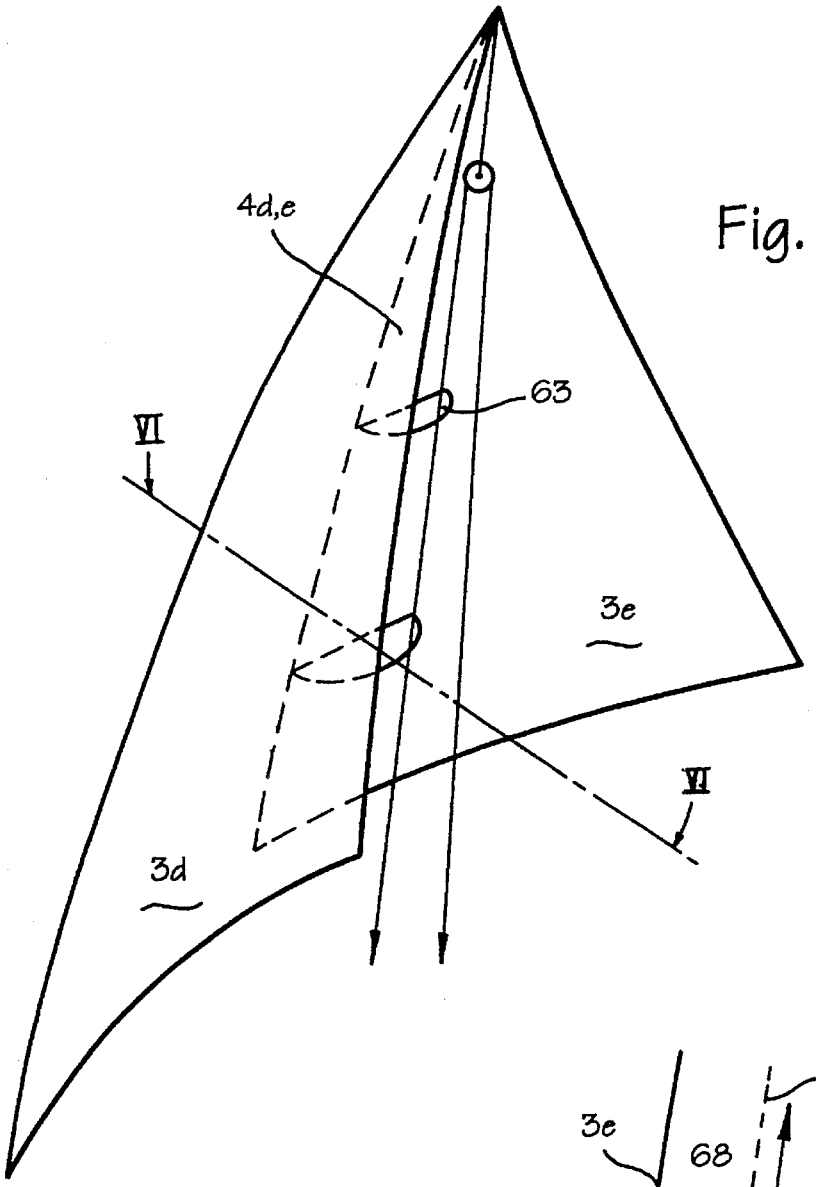
FIGS. 5 and 6 illustrate the position and the manoeuvring of spacers acting in the overlap zone of two sail structure sub-parts.
Figure 6:
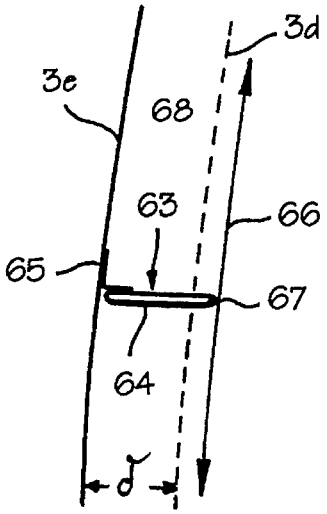

Such spacers 63 are visible in FIGS. 5 and 6 where a supple sail structure according to the invention has been represented, including only two sub-parts 3*d*, 3*e* having an overlap zone 4*d, e*. To allow the individual control of these sail structure sub-parts, the spacers are fixed just to one of them. As can be seen in FIG. 6, the spacers 63 consist of a component 64 mounted at right angles on a flexible support 65 fixed to the sail structure sub-part 3*e*, the component 64 or the junction with the support 65 being articulated. To modify the amount of space between the sail structure sub-parts 3*e*, 3*d*, it is possible to act on the spacers 63 by virtue of a pull cable system 66 on which is fixed, at 67, the part 64, which system lowers or raises this part 64 to a greater or lesser extent and therefore reduces or increases the amount of space δ obtained.

The second embodiment of the invention is distinguished from the first essentially in that this is the application of the invention in the case of a thick sail structure.

Figure 8:
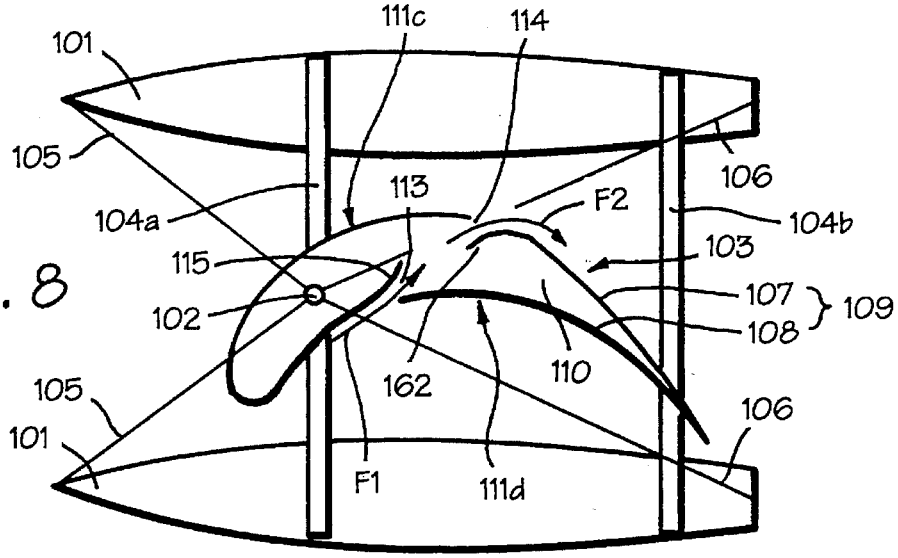
FIG. 8 is a section taken along the line VIII—VIII of FIG. 7, with the internal structure left out.

If FIG. 8 is examined first of all, it is seen that the device according to the invention equips a catamaran the floats of which are denoted by 101. These floats are connected by a pair of longitudinal members 104*a* and 104*b*, one of which, 104*a*, supports a rectangular mast 102 rigged at 105 on the leading edge of the floats and at 106 on their trailing edge. The two faces of the element of aerodynamic shape or sail structure 103 belong to distinct walls 107, 108 of a skin 109 which defines a hollow aerodynamic volume or cavity 110. The mast 102 passes through the cavity 110.

Figure 7:
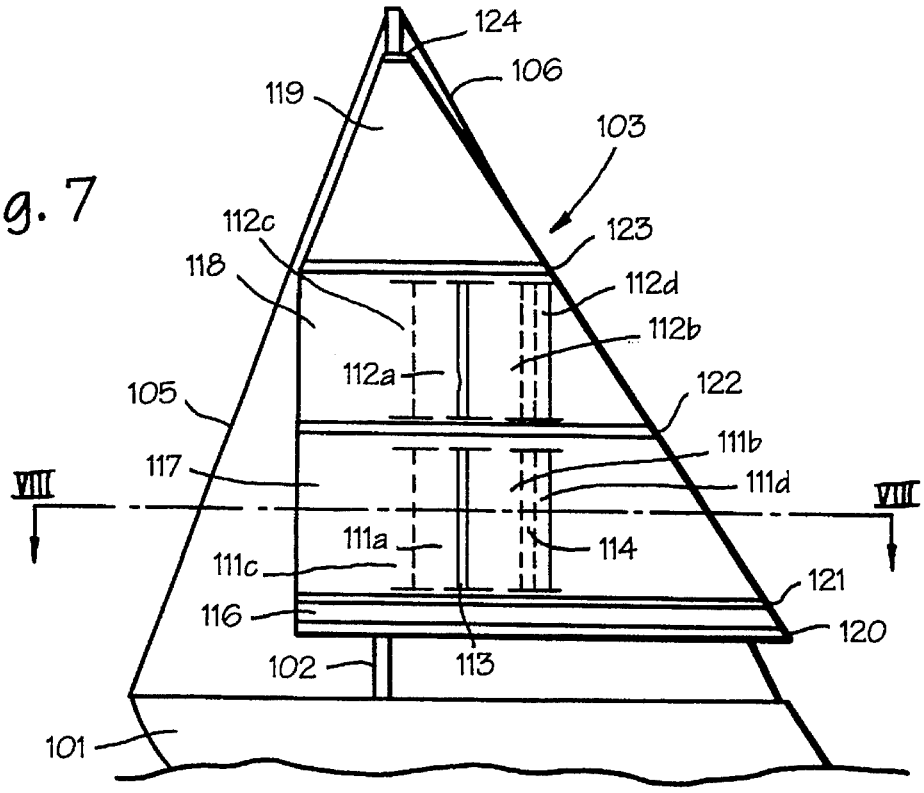
FIG. 7 is an overall view in elevation of a sailing craft equipped with the device according to the invention, in its second embodiment.

As also emerges from FIGS. 7 and 8, the sail structure 103 exhibits four pairs of flaps 111*a–d* and 112*a–d*. In the configuration represented, the face 108 is the pressure face and the face 109 the suction face. The flaps 111*a*, 111*b*, 112*a*, 112*b* are open and designed for the passage of air in the direction of the arrows F1 and F2 of FIG. 8. In contrast the flaps 111*c*, 111*d*, 112*c*, 112*d* are closed. If the concavity of the sail structure comes to be reversed, the position of the flaps is reversed. Hereafter, only the pairs of flaps 111*a*, 112*a*, 111*b*, 112*b* will be described.

The flaps each result from cut-outs in the shape of a reversed C and a normal C stuck together "back to back", which gives a configuration in the shape of a couched H, the bar of which constitutes the opening slit 113 or 114. The opening slits of the flaps 111*a* and 112*a*, on the one hand, and 111*b*, 112*b*, on the other hand, are respectively aligned so that they define, on each of the faces 107 and 108, a discontinuous slit line. By virtue of a structure which will be described later, and which is located in the cavity 110, the opening of the flaps 111*a, b* and 112*a, b* takes place, as is seen, without altering the aerodynamic curvature of the faces 107 and 108 of the sail structure 103.

In order to remove any ambiguity in the rest of the explanation, the notions of "downstream" and of "upstream" employed as regards the flaps refer to the ends of the flap with respect to the direction of flow of air over the latter.

The opening of the flaps 111*a*, 111*b* takes place respectively by displacing towards the inside of the cavity 110 the downstream edge 115 of the flap 111*a* and by displacing towards the inside of the cavity 110 the upstream edge 162 of the flap 111*b*.

Figure 8A:
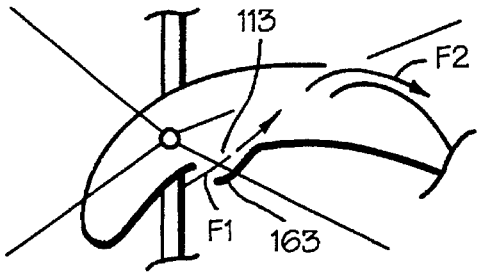
FIG. 8*a* is a variant of the embodiment of FIG. 8.

As a variant, FIG. 8*a* shows a case in which the upstream edge 163 of the flap 111*a* is displaced towards the outside of the cavity 110.

As is seen in FIG. 7, the sail structure 103 includes a lower stage 116, two intermediate stages 117 and 118, and an upper stage 119. The stages are defined by "frames" 120 to 123 and by an upper plate 124 to which is fixed a halyard for hoisting or hauling down the sail structure 103. A possible structure for these frames will be described by reference to FIG. 10.

Figure 9:
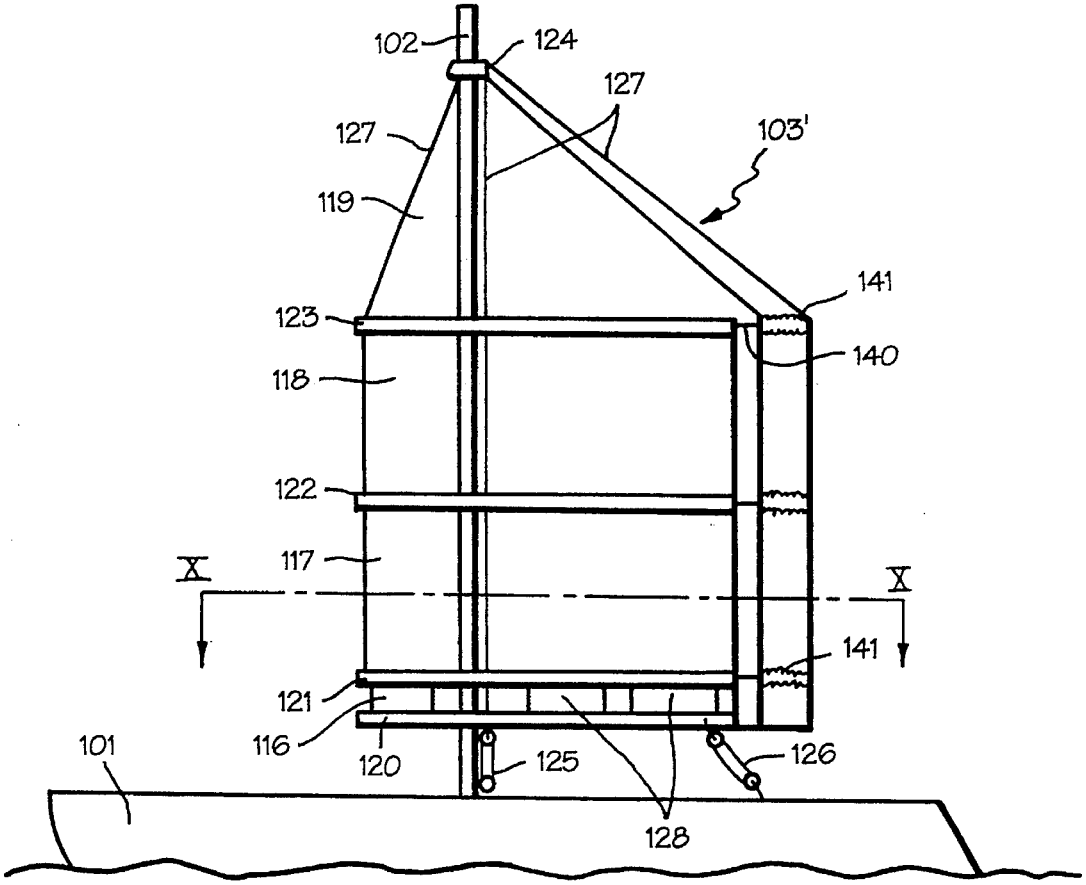
FIG. 9 shows a variant of the embodiment of FIGS. 7 and 8.

FIG. 9 shows a variant 103' of the sail structure 103 of FIGS. 7 and 8, without representing the flaps.

It is seen that cables 127 connect the upper plate 124 to the frames 123, 122 and 121 level with their leading edge, their trailing edge and close to the mast 102, making it possible to modify their spacing and limiting it to a maximum. Struts 128 made from folded sheet metal take up the mechanical loads which are due to the tension of the skin and to the pressures and decreased pressures exerted on these. They also fix the spacing between the frames 120 and 121. The frames 120 and 121 and their struts 128 thus form a stiffened assembly acting as a variable-geometry sprit.

To reduce the aerodynamic volume in terms of surface area, the distance between two frames and/or between one frame and one end of the aerodynamic volume may be reduced, one possible system being one with a reefing pendant.

A downhaul 125 and a sheet tackle 126 connect the lower frame 120 respectively to the longitudinal members 104*a* and 104*b* to tension and orientate the sail structure 103' with respect to the wind.

Figure 10:
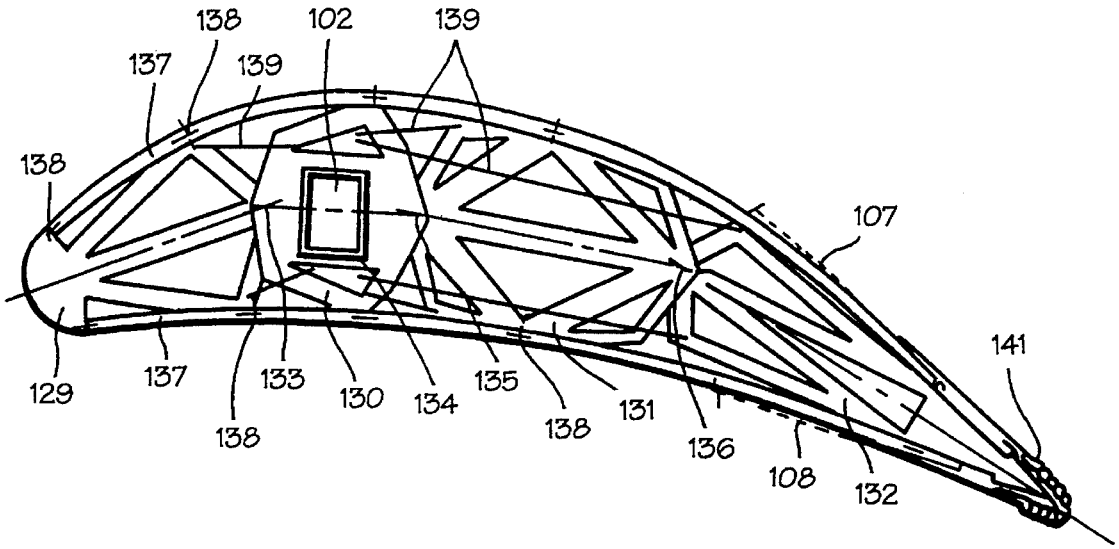
FIG. 10 is a section, on a larger scale, taken along the line X—X of FIG. 9, FIGS. 11 and 12 show, respectively, in elevation and in plan view, the adjustable cross-section zone of passage of the mast through a plate of the structure illustrated in FIG. 10.

The section of FIG. 10 shows how a frame may be produced, namely with the aid of several plates 129 to 132 arranged end to end and articulated together. More precisely, one end of the plate 129 forms the leading edge of the structure and its opposite end is articulated at 133 onto the plate 130 which exhibits an opening 134 for the passage of the mast 102. Opposite the plate 129, the plate 130 is articulated at 135 onto an intermediate plate 131, itself articulated at 136 onto a plate 132. Opposite the articulation 136, the plate 132 forms the trailing edge of the structure.

The skin absorbs the differences in length which are due to the reversibility of the concavity, to the curvature and to the twist. To do this, and/or to serve as a return means, the skin advantageously exhibits extensible parts and/or overlapping parts which are subjected to tensioning means such as 141.

Figure 11:
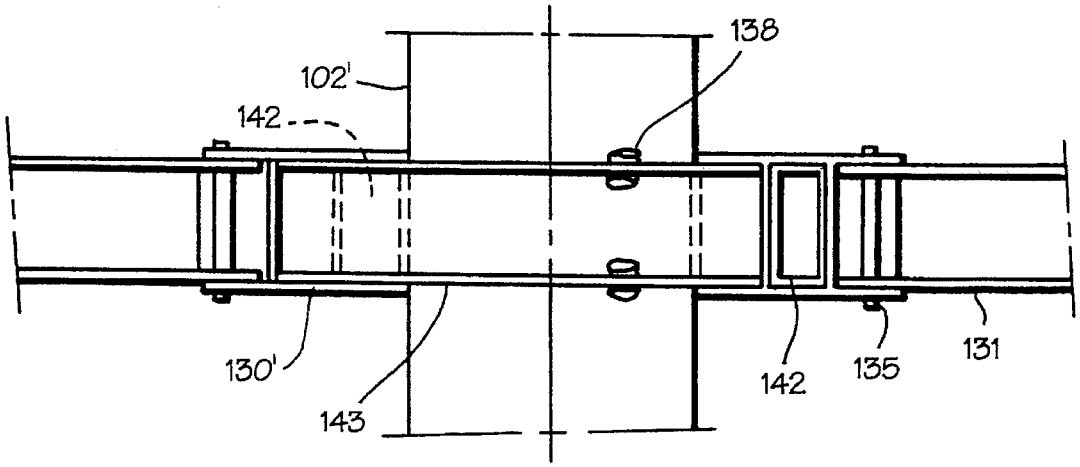

On each side of the assembly consisting of the plates 129 to 132 are arranged two flexible shaping battens 137 which are connected to the plates by virtue of tenons 138 fixed to the said plates and sliding in grooves 162 provided in the said battens (best visible in FIG. 11). The battens 137 are fixed to the walls 107 and 108 of the skin 109 or at the very least in contact with them. The walls 107 and 108 are represented diagrammatically only by a fragment of dotted line on the trailing edge side. In fact, at this level, the skin is made of two parts, one of them formed by the walls 107 and 108 and the other by a wall straddling the trailing edge, the ends of one overlapping the ends of the other. Cables 139 returned to the foot of the mast, control the relative position of the plates 129 to 132 with respect to each other so that by acting on these cables it is possible to modify the curvature of the frame formed by the said plates. As the shaping battens 137 are tributaries of the said plates, they follow their displacement and the skin 109 matches the shape assumed by the battens. The overlapping ends of the walls 107 and 108 of the skin are subjected to the tension of tensioners 141.

The geometry of the aerodynamic shape is obtained by acting appropriately on the length of each batten and/or on the position of each plate, taken in isolation or in combination, thus giving the desired shape to the profiles of the sail structure by distributing the curvature along the skeleton of the sail structure depending on the intensity of the overall curvature.

Figure 12:
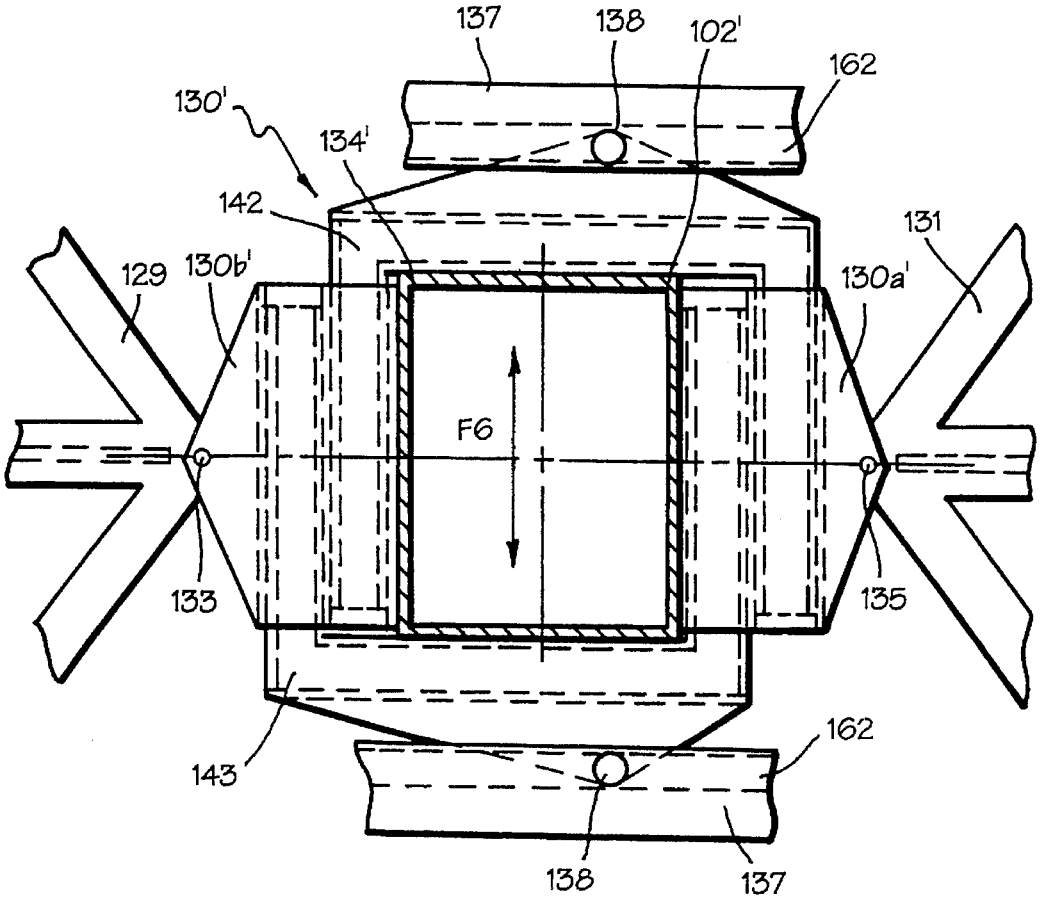

In a preferred embodiment, the plate 130 of FIG. 10—which exhibits an opening 134 of cross-section and geometry which are fixed by construction—is replaced by a plate 130' such as represented in FIGS. 11 and 12. This plate 130', made from two parts 130'*a* and 130'*b* has a structure such that the cross-section and the geometry of the opening 134' can be matched to those of a mast 102' on which it slides and which can proceed, tapering, it being possible for the cross-section of the mast at its top to be only 40%, for example, of what it is at its base. More precisely, the two parts 130'*a* and 130'*b* of the plate 130' are connected by two components having a U-shaped configuration 142 and 143 and which are nested together so that they can slide, top-to-toe, in the two parts 130'*a* and 130'*a* of the plate. The opening 134' consists of the space defined between the two parts 130'*a* and 130'*a* and the web of the U-shaped components 142, 143. A relative displacement of the said components 142 and 143 is manifested in a modification of the opening 134' in the direction of the double arrow F6. A device with a tensioner may be provided for tightening the webs of the U-shaped components about the mast 102'.

Figure 13:
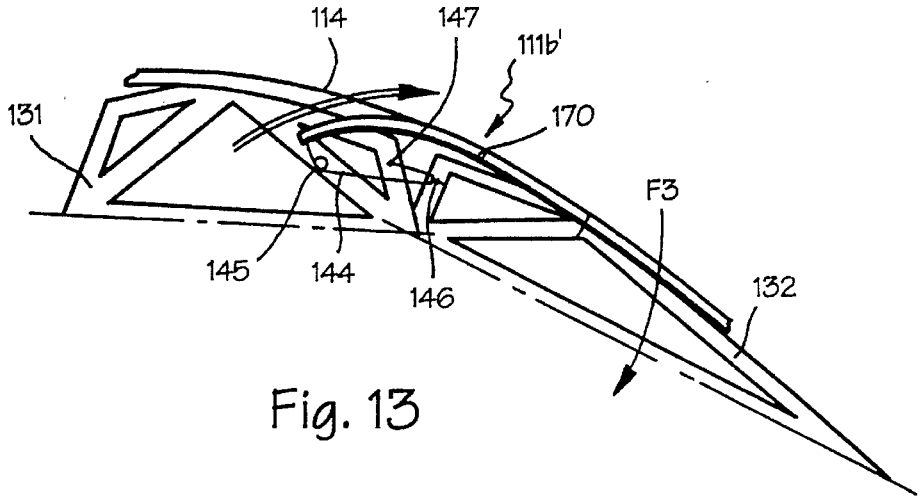
FIG. 13 is a partial representation of a variant of FIG. 10 showing a system for automatically controlling the opening of a flap as a function of the curvature.

FIG. 13 shows, in section, a partial representation of a frame in which a flap 111*b'* is open under the effect of a mechanism automatically controlled as a function of the curvature of the frame. This mechanism uses a cable 144 fixed to the upstream end of the flap 111*b'* where the free end of a batten 170 also ends. The cable 144 passes around a small return roller 145 dependent on the plate 131 and a second return roller 146 dependent on the plate 132, to return to the plate 131 onto which it is fixed at 147. When the plate 132 pivots in the direction of the arrow F3 to curve the frame, the roller 146 moves away from the point 147 at which the cable 144 is fixed, so that the length of the cable lying between them extends at the cost of that going from the roller 146 to the downstream end of the slit 114. A tension on this upstream edge and a corresponding opening of the flap follows.

Figure 14:
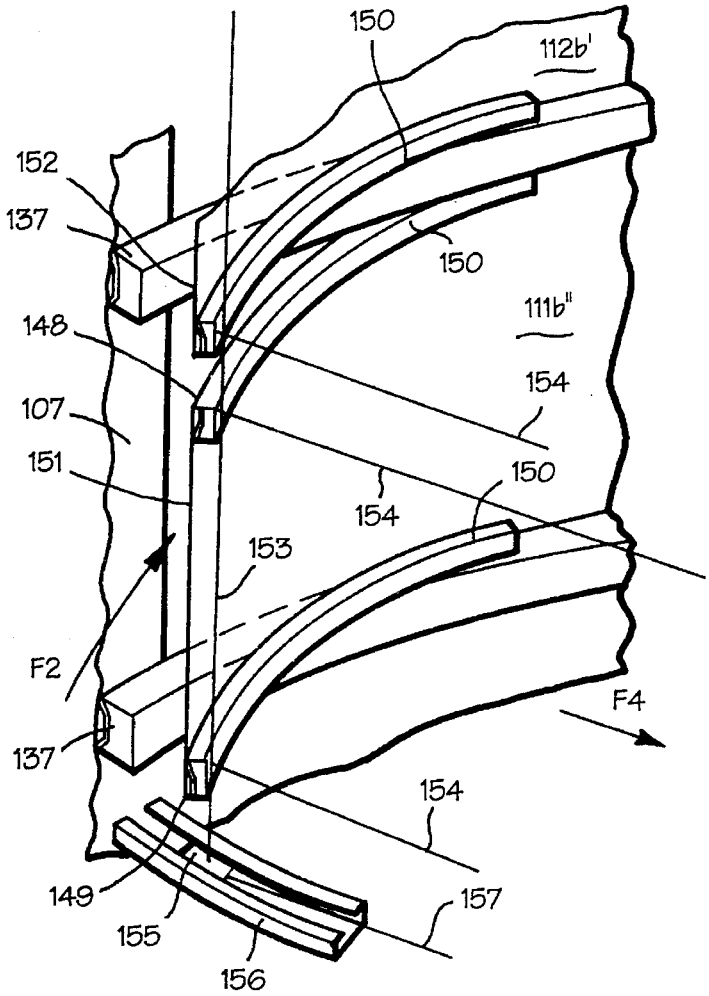
FIG. 14 is a detailed view on a larger scale and in isometric projection showing the articulation of a flap.

FIG. 14 shows another means making it possible to control the flaps. In this figure, the wall 107 of the skin can be seen in which are formed two flaps 111*b*" and 112*b*", the latter being represented only partially. The wall 107 is shaped by means of the battens 137. The flap 111*b*" has the overall shape of a C, the upper 148 and lower 149 branches of which are fitted with manoeuvring battens 150 one end of which is flush with the vertical branch 151 of the C which defines the slit for opening the flap. The flap 112*b*" is designed in the same way but only its slit 152, aligned with the slit 151, and its lower manoeuvring batten 150 can be seen.

In the vicinity of the slits 151, 152, the manoeuvring battens 150 serve as anchoring points, on the one hand for a cable 153 which connects them together and, on the other hand, for a series of parallel cables 154 which are perpendicular to the cable 153. One of the ends of the cable 153 is secured to a carriage 155 mounted so that it can slide in a slideway 156, which carriage 154 [sic] is itself manoeuvred with the aid of a cable 157 parallel to the cables 154. It is understood that tension exerted in the direction of the arrow F4 on the cables 154 and 157 opens the flaps 111*b*" and 112*b*" allowing air to pass in the direction of the arrow F2. The cables 154 and 157 may be controlled as is the cable 144 of FIG. 13.

Figure 15:
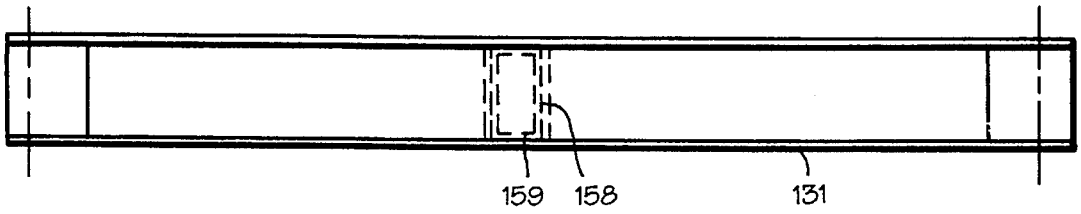
FIGS. 15 and 16 show, respectively in elevation and in plan view, a means for linking between a plate of the structure of FIG. 10 and a shaping batten.
Figure 16:
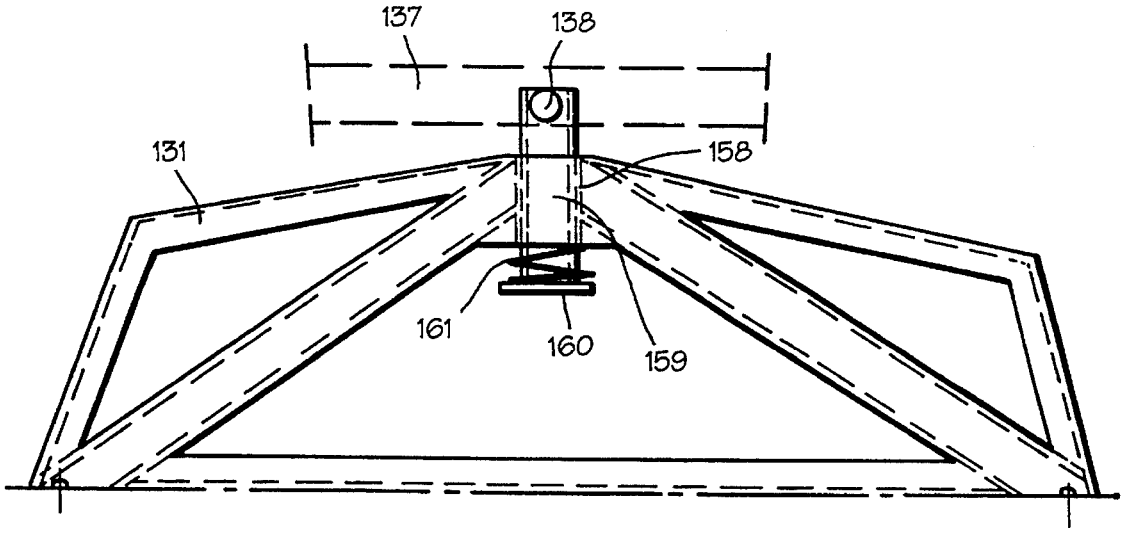

FIGS. 15 and 16 show a method for linking a plate, for example the plate 131, to a shaping batten 137 which allows the variation in thickness of the profile of the sail structure. The plate offers a sheath 158 forming, on the one hand, a guide for a piston rod 159 which piston has a head 160 and, on the other hand, support for a tenon 138 of a batten 137. A spring 161 bears on the head 160 and on the external wall of the sheath 158 by pulling on the tenon 138 and therefore on the shaping baton 137, thus constraining the said batten to follow the movements of the plate. The piston rod 159 could, as a variant, be controlled by a cable and tensioner system for displacing the piston 159 and thus varying the thickness of the profile.

The third embodiment of the invention proceeds, as stated above, from the first one and from the second one.

Figure 17:
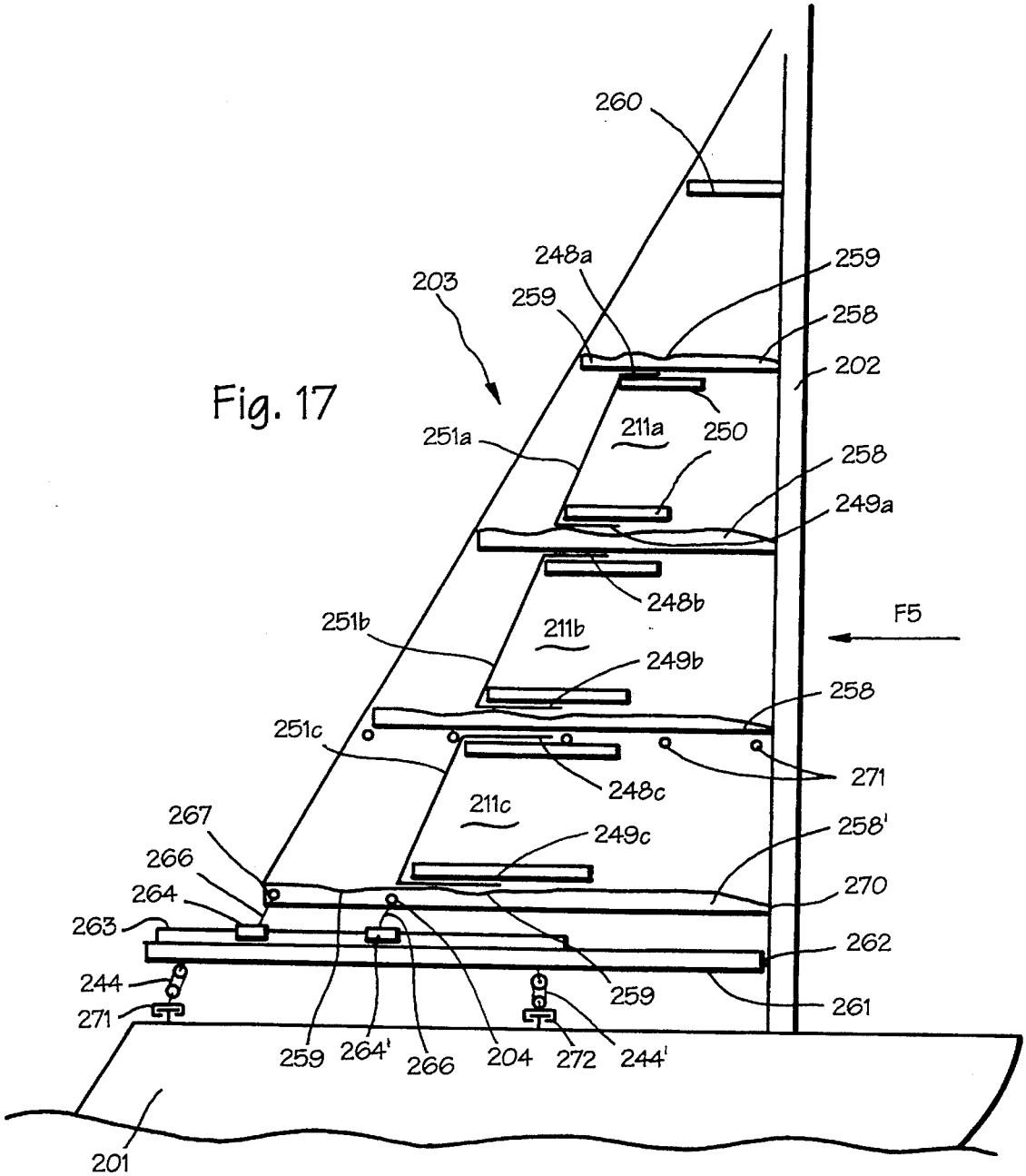
FIG. 17 is an overall view in elevation of a sailing craft equipped with the device according to the invention, in its third embodiment.

If reference is made to FIG. 17, a sailing craft can be seen having a hull 201 equipped with a mast 202, which is not rigged, integrated into a sail structure 203 equipped with a reduction system using reefing points 271. There is provided, in the sail structure, a series of flaps 211*a*, 211*b*, 211*c*, each of which has substantially the shape of a slightly oblique C. Since these flaps are identical, only the flap 211*a* will be described.

The upper 248 and lower 249 branches of the C-shaped slit 211*a* are approximately parallel to the direction of flow of the air (arrow F5) and they are equipped with stiffening battens 250. The stiffened slits 248 and 249 are joined by a supple slit 251*a* the direction of which is a little off perpendicular with respect to that of the arrow F5. The slits 251*a–c* of the flaps 211*a–c* are aligned and in their alignment is provided a hauling point at 204. The sail structure 203 is equipped with a series of control battens 258, on either side of each of the flaps 211*a–c*, and which exhibit zones 259 which are weakened in terms of their rigidity, so that these zones 259 create points of preferred bending for the battens 258. In practice, the thickness of the battens 258 is constant but their height exhibits variations. It will be noted that one of the battens 258—referenced 258'—is coextensive with the lower edge of the sail structure 203. There is finally provided a batten 260 of constant cross-section at the top of the sail structure. The flexibility of the control battens 258 and of the batten 260 allows the reversibility of the concavity and going about. The battens 250, 258 and 260 are housed in sheaths formed in the sail structure and taking part in setting the curvature and/or the twist.

A flexible boom 261 is articulated at 262 onto the mast 202, which boom is connected to the deck by a sheet tackle 244 and by another tackle 244' each interacting with a system of a carriage 271, 272 and rail, as represented more clearly in FIG. 1 (references 44, 45, 46). It is thus possible to orientate the boom with respect to the hull 201 and with respect to the wind.

The boom 261 itself serves as a support for a rail 263 on which there slide two carriages 264 and 264' which are connected respectively to the hauling points 267 and 204, by two sheets 266 and 266', so as to set the distance between the various hauling points of the edge of the sail with respect to the anchoring point 270, and to participate in fixing the intensity of the overall curvature of the sail structure.

Figure 18:
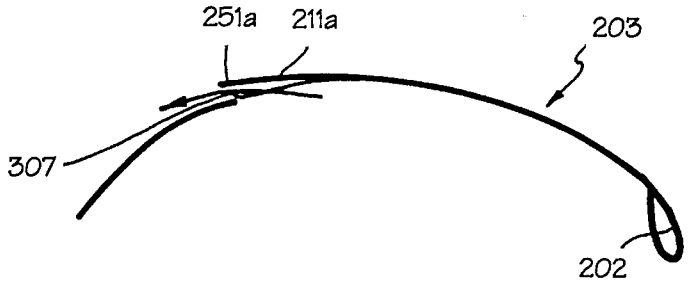
FIG. 18 is a diagrammatic representation, in section, of a method of opening a flap of FIG. 17.

When the boom 261 is curved by acting on the position of the carriages 271 and 272, the control battens 258 and 258' bend, particularly in the zones of lesser rigidity 259, whereas the stiffening battens 250 resist the bending. There then follows the opening of the flaps 211*a–c* as seen diagrammatically in FIG. 18 where a rope 307 can also be seen which limits the outward deflection of the flap 211*a*. This is therefore a simplified solution for controlling the flaps.

Figure 19:
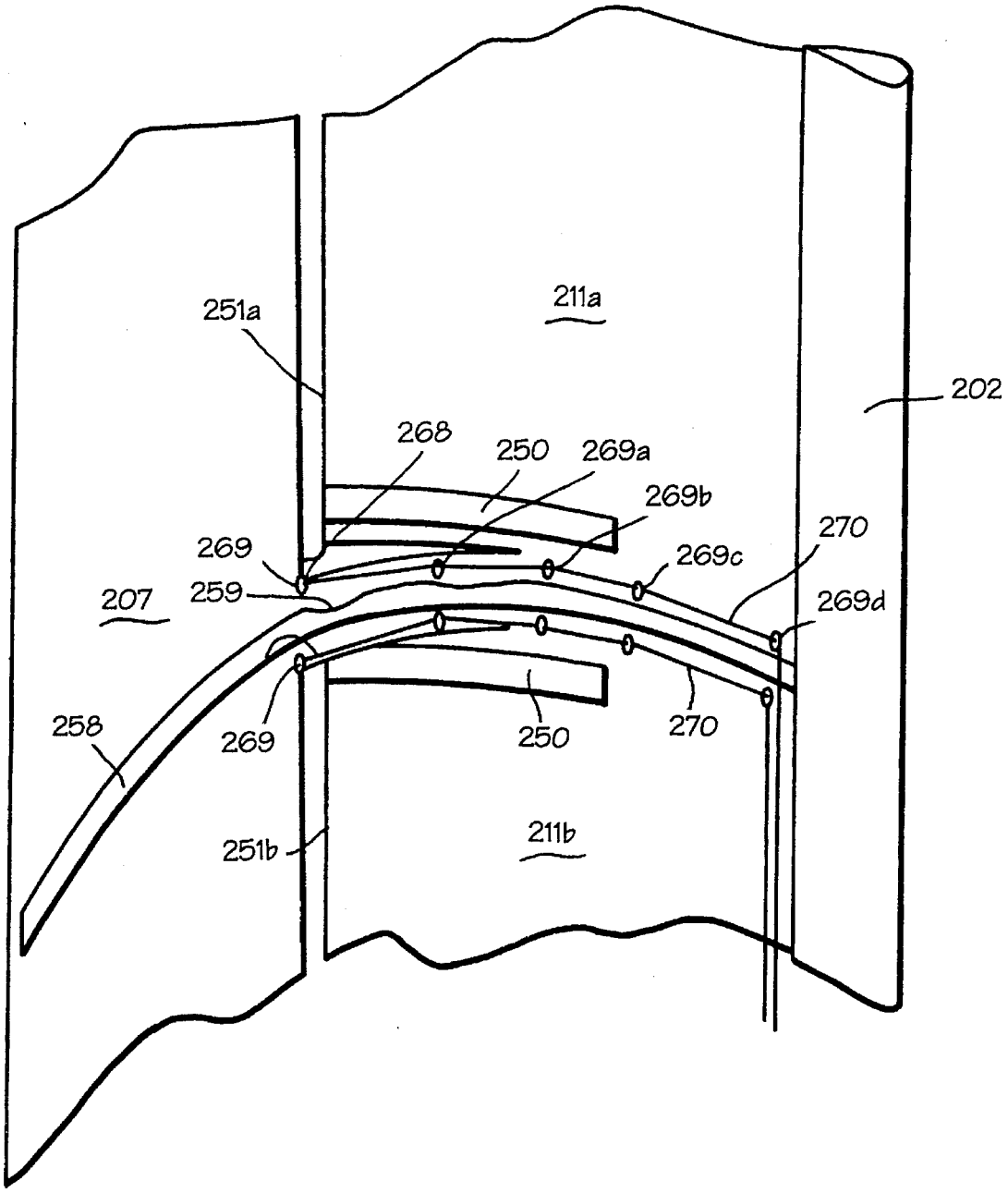
FIG. 19 is a detailed view on a larger scale showing means for directly manoeuvring a flap of the device according to FIG. 17.

The setting can, however, be refined by equipping the flaps with means which act directly on the flaps and which are represented in FIG. 19. In this case, a rope anchoring point is provided at each end 268 of the supple slits 251*a, b* and, opposite, on the outside of the flaps, in the sail structure 207, a rope guide 269 is provided. A series of cable guides

269*a*–269*d* is also provided along the stiffened slits and right up to the mast 202. The rope guides may be rings fixed to the sheaths of the battens. A rope 270 connects each anchoring point 268 to the guide 269, passes through the series of guides 269*a–d* and is returned, from the most downstream guide 269*d*, to a control means. It is understood that tension on the ropes 270 ends in closing the flaps.

The invention is not limited to the embodiments described and represented by way of examples.

In particular, and among other possible variants:

any fraction whatsoever of the element of aerodynamic shape may have a thick profile and the movable part or parts of the said element may equally well be located in a thin zone as in a thick zone;

instead of being connected to the carriages 45, 48, 51 (FIGS. 1 and 1*a*) by means of a spar and tackle system, the hauling points, such as 5 to 10, 264, 204, could be connected directly to these carriages;

any fraction whatsoever of a frame or of a series of frames, according to the second embodiment, could consist of an articulated metal lattice, instead of consisting of one or more plates; as a variant, the entire variable-geometry structure could consist of such a lattice;

instead of being equipped with two stiffening battens 250 (FIG. 17), each flap could be equipped with just one batten occupying the entire height of the flap: in this case, the height of the flap would be designed so as not to inhibit the bending of the sail structure;

one or more control battens 258 (FIG. 17), that is to say including at least one zone of preferred flexibility, could be used in an embodiment other than that of FIG. 17, to better control the shape of the parts or zones of the sail structure, or recourse could even be had, for this purpose, to one or more conventional battens such as 260;

on a sail structure including at least two leading edges, at least one such edge could be equipped with a variable-geometry stiffening element, which is continuous or discontinuous and/or with at least one hauling point between the two ends of the said leading edges.

Finally, it is clearly understood that one and the same craft may be equipped with several devices according to the invention and/or that one and the same device may combine various embodiments, that is to say, for example, include a sail structure made as a single part divided into two sub-parts having an overlap zone forming a slit, one and/or both sub-parts being equipped with flaps forming complementary slits.

I claim:

1. A device for a craft comprising:

(a) at least one element of aerodynamic shape, and having a pressure face side and a suction face side, said at least one element including at least one part for being folded up for propulsion and/or lift of the craft using the effect of wind;

(b) said at least one element comprising a sail structure divided into at least two parts along a dividing line, the at least two parts collectively forming a sail structure surface defining at least one opening therein for providing a passage of air from the pressure face side to the suction face side of said at least one element;

(c) guide means for guiding the air emerging from said at least one opening on the suction face side of said at least one element in a direction tangential to said at least one element, said guide means comprising an overlap zone defined between consecutive ones of the at least two parts, and the sail structure including a slit located at the dividing line and defined by the spacing between the consecutive sail structure parts in the overlap zone, said spacing being maintained by at least one spacer fixed to one of the two consecutive sail structure parts;

(d) first positioning means operatively connected to said at least one element for controlling both the position and the geometry of the at least one part of said at least one element, and for adjusting the geometry and the opening/closing of said at least one opening and said guide means of the air passage; and (e) second positioning means for setting the geometry of said at least one element, the geometry including the curvature of said at least one element in terms of hollow and in terms of shape.

2. A device for a craft comprising:

(a) at least one element of aerodynamic shape, and having a pressure face side and a suction face side comprising separate skin parts defining a hollow aerodynamic volume therebetween, and said at least one element including at least one part for being folded up for propulsion and/or lift of the craft using the effect of wind;

(b) a pair of flaps formed respectively in the pressure face side and the suction face side of said at least one element, said flaps of the at least one element defining at least one opening for providing a passage of air from the pressure face side to the suction face side of said at least one element, and guide means for guiding the air emerging from said at least one opening on the suction face side of said at least one element in a direction tangential to said at least one element;

(c) control means operatively connected to said flaps for controlling the opening/closing, orientation and geometry of the flaps;

(d) first positioning means operatively connected to said at least one element for controlling both the position and the geometry of the at least one part of said at least one element, and for adjusting the geometry and the opening/closing of said at least one opening and said guide means of the air passage; and (e) second positioning means for setting the geometry of said at least one element, the geometry including the curvature of said at least one element in terms of hollow and in terms of shape.

3. A device according to claim 2, wherein said control means for controlling said flaps are included in a variable-geometry structure housed in a cavity of the hollow aerodynamic volume.

4. A device for a craft comprising:

(a) at least one element comprising a sail structure of aerodynamic shape, and having a pressure face side and a suction face side, said at least one element including at least one part for being folded up for propulsion and/or lift of the craft using the effect of wind;

(b) a generally C-shaped flap defining at least one opening therein for providing a passage of air from the pressure face side to the suction face side of said at least one element, and guide means for guiding the air emerging from said at least one opening on the suction face side of said at least one element in a direction tangential to said at least one element, said flap including a supple slit extending substantially perpendicular to a direction of air flow in a normal position of use, and two stiffened slits extending substantially parallel to the direction of air flow in the normal position of use;

(c) first positioning means operatively connected to said at least one element for controlling both the position and the geometry of the at least one part of said at least one element, and for adjusting the geometry and the opening/closing of said at least one opening and said guide means of the air passage; and (d) second positioning means for setting the geometry of said at least one element, the geometry including the curvature of said at least one element in terms of hollow and in terms of shape.

5. A device according to claim 4, and including control means for controlling the flap, said control means comprising at least one control batten included in the sail structure, said at least one control batten extending in a direction substantially parallel to the stiffened slits, and having at least one zone of weakened stiffness for promoting the bending of said at least one control batten.

6. A device according to claim 4, and including maneuvering means operatively connected to said flap for maneuvering said flap.

7. A device according to one of claims 1 or 4, wherein the sail structure includes at least two leading edges, and at least one of said leading edges including an adjustable and variable-geometry stiffening element.

8. A device according to one of claims 1 or 4, wherein the sail structure includes at least two leading edges, and at least one hauling point located between first and second ends of at least one of said leading edges.

* * * * *